US005779880A

United States Patent [19]

Maruyama et al.

[11] Patent Number: 5,779,880

[45] Date of Patent: Jul. 14, 1998

[54] CARBONACEOUS POWDER TO BE DISPERSED IN ELECTRORHEOLOGICAL FLUID AND ELECTRORHEOLOGICAL FLUID USING THE SAME

[75] Inventors: Takayuki Maruyama; Takao Ogino; Yuichi Ishino; Tasuku Saito, all of Tokyo; Takashi Haraoka, Chiba; Kaori Takagi, Chiba; Hitomi Hatano, Chiba, all of Japan

[73] Assignees: Bridgestone Corporation; Kawasaki Steel Corporation, both of Tokyo, Japan

[21] Appl. No.: 667,932

[22] Filed: Jun. 24, 1996

Related U.S. Application Data

[62] Division of Ser. No. 347,061, Nov. 23, 1994, abandoned.

[30] Foreign Application Priority Data

Dec. 1, 1993 [JP] Japan ..... 5-325797

[51] Int. Cl.[6] ..... C10C 1/20

[52] U.S. Cl. ..... 208/44; 208/39

[58] Field of Search ..... 208/39, 44

[56] References Cited

U.S. PATENT DOCUMENTS

| | | | |
|---|---|---|---|
| 4,789,455 | 12/1988 | McChida et al. | 208/39 |
| 5,087,382 | 2/1992 | Ishino et al. | 252/73 |
| 5,106,521 | 4/1992 | Kurachi et al. . | |
| 5,182,010 | 1/1993 | Mochida et al. | 208/44 |
| 5,332,517 | 7/1994 | Torii et al. | 252/73 |
| 5,352,718 | 10/1994 | Ishino et al. | 524/66 |

FOREIGN PATENT DOCUMENTS

| | | |
|---|---|---|
| 0406853 | 1/1991 | European Pat. Off. . |
| 0548956 | 6/1993 | European Pat. Off. . |
| 61-216202 | 9/1986 | Japan . |
| 63-97694 | 4/1988 | Japan . |
| 1-164823 | 6/1989 | Japan . |
| 3-279206 | 12/1991 | Japan . |
| 5-810 | 1/1993 | Japan . |
| 6-228581 | 8/1994 | Japan . |

*Primary Examiner*—Helane Myers
*Attorney, Agent, or Firm*—Oliff & Berridge, PLC

[57] ABSTRACT

An electrorheological fluid is constituted by using a dispersed phase of a carbonaceous powder having an oxygen content above 10% by weight but not more than 20% by weight and having an average particle diameter of 0.01–100 μm, obtained by:

heat-polymerizing a condensed polycyclic aromatic compound containing a main component of naphthalene by using $HF/BF_3$ as a catalyst to obtain a 100% meso-phase pitch having a softening point within a range of 150°–400° C.;

heat-treating and making the pitch infusible in an oxidizing atmosphere at a temperature not more than a fusing temperature of the pitch and not less than 50° C. but not more than 400° C. to allow the pitch to have an oxygen content of 12–25% by weight; and then heat-treating and carbonizing the pitch in an inert gas atmosphere at a temperature not less than 300° C. but not more than 700° C.

It is thus possible to obtain an electrorheological fluid having low current consumption, a high electrorheological effect and excellent long-term durability, even when the carbonaceous powder having high oxidation resistance and a high oxygen content is used.

6 Claims, No Drawings

CARBONACEOUS POWDER TO BE DISPERSED IN ELECTRORHEOLOGICAL FLUID AND ELECTRORHEOLOGICAL FLUID USING THE SAME

This is a Division of application Ser. No. 08/347,061 filed Nov. 23, 1994, now abandoned.

BACKGROUND OF THE INVENTION

1. Field of the Invention

The present invention relates to a carbonaceous powder suitable as a dispersed phase of an electrorheological fluid having its viscosity which increases in accordance with application of a voltage, and to the electrorheological fluid which uses the same as the dispersed phase.

2. Related Art

The electrorheological fluid is a suspension in which finely pulverized hydrophilic solid is dispersed in hydrophobic and non-conductive oil, in which the viscosity of the liquid increases extremely rapidly and reversibly under an action of a sufficiently strong electric field to give a solid state. The current required for the large increase in viscosity is very small, and electric fields of direct and alternating currents can be used. Thus it can be used, for example, for construction elements of clutches, hydraulic valves, shock absorbers, vibrators, vibration-isolation rubber, or interfaces of electric machines for controlling a system for holding a workpiece at a normal position.

In the prior art, those which use cellulose, starch, silica gel, ion exchange resin, lithium polyacrylate or the like pulverized after adhesion of water through the surface are known as solid particles for a dispersed phase as one construction element of an electrorheological fluid, and those which use polybiphenyl chloride, butyl sebacate, transformer oil, chlorinated paraffin, silicone oil or the like are known as a liquid phase as the other construction element. However, they are poor in properties for practical use, and there has been present no electrorheological fluid having extremely high performance and high stability and having a value for practical use.

Characteristics required for a practical electrorheological fluid include, for example, indication of a large electrorheological effect, small current consumption, instant response to an electric field, possibility of use in a wide temperature range, and stability possessed over a long term.

However, in the case of the water-containing electrorheological fluid as described above which uses particles with absorbed water as a dispersed phase, it is ion that is used as an electric charge carrier for expressing an electrorheological effect. Thus a problem has arisen in that the conductivity extremely increases at a high temperature even when the conductivity is low in the vicinity of room temperature, and the current consumption becomes extremely high, or a problem has arisen in that evaporation of water takes place at a high temperature, and the electrorheological effect and response becomes worse. Therefore, the conventional water-containing electrorheological fluid had an upper limit of temperature for the use which was about 70°–80° C., and it was impossible to make application to the use in a high temperature environment such as an engine room of an automobile.

A non-aqueous electrorheological fluid using particles containing no water has been proposed as a method for improving the drawbacks of the water-containing electrorheological fluid. As such a non-aqueous electrorheological fluid, there are known, for example, a fluid in which organic semiconductor particles such as polyacene quinone are used as a dispersed phase (Japanese Patent Laid-open No. 61-216202), and a fluid in which dielectric particles with an electrically insulating thin film layer formed on a conductive thin film layer formed on surfaces of organic or inorganic solid particles are used as a dispersed phase (Japanese Patent Laid-open Nos. 63-97694 and 1-164823). However, these non-aqueous electrorheological fluids have not been practically used until present because the long-term stability of characteristics is deficient, the reproducibility is poor, the current consumption is large, and industrial production is difficult.

Japanese Patent Laid-open No. 3-279206 proposes a carbonaceous powder for an electrorheological fluid which satisfies at least one of conditions that a value of a ratio (C/H) of carbon atoms and hydrogen atoms is within a range of 1.70–3.50, and that an amount of weight decrease in a temperature range of 400°–600° C. in a nitrogen atmosphere is within a range of 0.5–13.0% by weight. This carbonaceous powder is obtained by a heat treatment with a highest temperature of 300°–800° C. by using a raw material of an organic compound selected from the group consisting of coal, coal tar, pitch, liquefied coal, cokes, petroleum, petroleum tar, pitch and resins. It is described that the concentration of oxygen contained in the carbonaceous powder is desirably not more than 3.0% by weight, and if the oxygen content exceeds 3.0% by weight, the current consumption of an electrorheological fluid which uses the carbonaceous powder as a dispersed phase rapidly increases. However, such a carbonaceous powder having an oxygen content not more than 3.0% by weight has a drawback in that it is inferior in oxidation resistance, oxidation proceeds due to oxygen in air, and the oxygen content gradually increases. Thus in order to avoid deterioration in electrorheological characteristics due to the increase in oxygen content, it is necessary to take careful consideration for storage, handling and isolation from air during use.

As a carbonaceous powder with its oxidation resistance improved by previously containing a sufficient amount of oxygen not to cause increase in oxygen content due to oxygen in air to provide an electrorheological fluid using it as a dispersed phase having small current consumption even if the oxygen content is high, Japanese Patent Laid-open No. 5-810 proposes a carbonaceous powder to be dispersed in an electrorheological fluid, in which a pitch powder is heat-treated and made infusible in an oxidizing atmosphere at a temperature not more than its fusing temperature and not less than 50° C. but not more than 400° C. to give an oxygen content of 3–25% by weight, followed by carbonization by a heat treatment in an inert gas atmosphere at a temperature not less than 300° C. but not more than 700° C. to give an oxygen content of 3–10% by weight, optionally involving particle size adjustment to give an average particle diameter of 0.01–100 microns. Although the oxygen content is 3–10% by weight, the oxidation resistance and the power consumption amount of an obtained electrorheological fluid are not necessarily satisfactory, and improvement has been desired.

DISCLOSURE OF THE INVENTION

An object of the present invention is to provide a carbonaceous powder which gives low current consumption of an electrorheological fluid even when the oxygen content is higher, and provide an electrorheological fluid using the same as a dispersed phase.

According to the present invention, there is provided a carbonaceous powder to be dispersed in an electrorheological fluid, having an oxygen content above 10% by weight but not more than 20% by weight and having an average particle diameter of 0.01–100μm, obtained by:

heat-polymerizing a condensed polycyclic aromatic compound containing a main component of naphthalene by using $HF/BF_3$ as a catalyst to obtain a 100% meso-phase pitch having a softening point within a range of 150°–400° C.;

heat-treating and making the pitch infusible in an oxidizing atmosphere at a temperature not more than a fusing temperature of the pitch and not less than 50° C. but not more than 400° C. to allow the pitch to have an oxygen content of 12–25% by weight; and then heat-treating and carbonizing the pitch in an inert gas atmosphere at a temperature not less than 300° C. but not more than 700° C.

The carbonaceous powder is preferably prepared to have the average particle diameter of 0.01–100 μm by means of particle size adjustment.

The pitch is preferably made infusible at a temperature not less than 200° C. but not more than 300° C.

The inert gas is preferably nitrogen or argon.

According to the present invention, there is provided an electrorheological fluid comprising:

(a) 1–60% by weight of a dispersed phase comprising a carbonaceous powder having an oxygen content above 10% by weight but not more than 20% by weight and having an average particle diameter of 0.01–100 μm, obtained by;

heat-polymerizing a condensed polycyclic aromatic compound containing a main component of naphthalene by using $HF/BF_3$ as a catalyst to obtain a 100% meso-phase pitch having a softening point within a range of 150°–400° C.;

heat-treating and making the pitch infusible in an oxidizing atmosphere at a temperature not more than a fusing temperature of the pitch and not less than 50° C. but not more than 400° C. to allow the pitch to have an oxygen content of 12–25% by weight; and then heat-treating and carbonizing the pitch in an inert gas atmosphere at a temperature not less than 300° C. but not more than 700° C.; and (b) 40–99% by weight of a liquid phase comprising an electrically insulating oil having a viscosity of 0.65–1000 centi-Stokes at room temperature.

The electrically insulating oil preferably has a viscosity of 10–200 centi-Stokes at 25° C.

The electrorheological fluid preferably contains 20–50% by weight of the dispersed phase, and 50–80% by weight of the liquid phase.

The carbonaceous powder preferably has an average particle diameter within a range of 0.3–10 μm.

The 100% meso-phase pitch having a softening point within a range of 150°–400° C. obtained by heat-polymerizing a condensed polycyclic aromatic compound containing a main component of naphthalene by using $HF/BF_3$ as a catalyst (at not less than 150° C.) is used as a starting raw material for producing the carbonaceous powder of the present invention. No considerable increase in current consumption is observed even in the case of an oxygen content exceeding 10% by weight, only when this pitch is used. Whether or not the meso-phase is provided, that is an optically inactive stereoisomer is provided or not, can be confirmed by observation with a polarization microscope.

Such a 100% meso-phase pitch is used as the starting raw material, and it is heat-treated (subjected to an infusibility treatment) in an oxidizing atmosphere at a temperature not more than its fusing temperature and not less than 50° C. but not more than 400° C., preferably not less than 200° C. but not more than 300° C. The infusibility treatment is performed in order to suppress fusing in the next carbonizing treatment step. Namely, a 100% meso-phase pitch not subjected to the infusibility treatment is fused in the carbonizing step and gives a bulky state which is difficult for powder formation, however, the fusion is suppressed by the infusibility treatment, and powder formation after carbonization becomes easy.

The oxygen content in the raw material pitch is increased by the infusibility treatment in the oxidizing atmosphere. The oxygen content at this stage greatly affects the oxygen content of a carbonaceous powder obtained by the carbonizing treatment in the next step. Sufficient oxygen should be contained in this infusibility treatment because the carbonizing treatment in the next step is a heat treatment in an inert gas atmosphere, and the oxygen content is in a tendency of decrease. In order to allow the oxygen content of the carbonaceous powder after the carbonization to be above 10% by weight but not more than 20% by weight, it is suitable that the oxygen content of the pitch after the infusibility treatment is 12–25% by weight. The higher the infusibility treatment temperature is, and the longer the infusibility treatment time is, the more the oxygen content is increased. It is speculated that most of oxygen is integrated into aromatic rings in a form of ether bond.

Any infusibility treatment can be adopted provided that it is a procedure carried out in an infusibility step for pitch type carbon fibers. A standard method in the infusibility treatment for pitch type carbon fibers is a method in which air is used as an oxidizing atmosphere to perform heating at a temperature in the vicinity of a spinning temperature of the pitch, however, various improvements have been made in order to reduce the infusibility treatment time ("Carbon Fiber", p153, Kindai-Hensyu Co., Ltd.). For example, such methods are used in which air oxidation is performed after applying an ozone treatment at a temperature not more than about 70° C., air which contains carbon dioxide is used, a mixed gas of chlorine and oxygen is used, air oxidation is performed after immersion in a saturated aqueous chlorine solution, or air oxidation is performed after a treatment with bromine gas and fine powder of activated carbon impregnated with sulfuric acid. The same procedures as those of the pitch type carbon fibers can be also applied to the present invention. If the infusibility treatment temperature is less than 50° C., the cross-linking reaction by oxidation becomes difficult to proceed irrelevant to any improvement, and it is impossible to suppress fusion in the next carbonizing step, while if the infusibility treatment temperature exceeds 400° C., combustion of the pitch takes place. Further, even when the combustion of the pitch does not take place, in case of an infusibility treatment temperature exceeding 400° C., a number of continued aromatic rings increases due to extreme proceeding of the cross-linking reaction by oxidation, and the conductivity of powder after carbonization increases, resulting in large current consumption of an electrorheological fluid. It is recommended that a preferable infusibility treatment temperature is set in the vicinity of a fusing temperature of the pitch. Namely, the infusibility treatment temperature is preferably not less than 200° C. but not more than 300° C. because the fusing temperature becomes 200°–300° C. by means of a treatment for removing low boiling point components of the aforementioned pitch.

The heat treatment (carbonizing treatment) in an inert gas atmosphere is performed by using an inert gas, preferably nitrogen gas or argon gas as the atmosphere at a temperature not less than 300° C. but not more than 700° C., preferably at a temperature not less than 350° C. but not more than 550° C.. If the temperature is low (less than 300° C.), generation of continued aromatic rings becomes insufficient, and the electrorheological effect of an electrorheological fluid becomes small. On the other hand, if the carbonizing temperature is high (above 700° C.), the conductivity of powder is extremely increased, resulting in large current consumption of an electrorheological fluid.

The content of oxygen in the carbonaceous powder obtained by the carbonizing treatment is controlled to be above 10% by weight but not more than 20% by weight. As described above, the oxygen content is in a tendency of decrease in the carbonizing treatment. The higher the carbonizing treatment temperature is, and the longer the carbonizing time is, the larger the decrease in oxygen content is. Thus the oxygen content in the infusibility treatment step is somewhat increased taking the decrease in this step into consideration. If the oxygen content is low, characteristics are deteriorated due to oxidation of the carbonaceous powder by oxygen in the atmosphere, while if the oxygen content is too high (exceeding 20% by weight), the conductivity of powder becomes large, and the current consumption of an electrorheological fluid increases, as being disadvantageous.

In the present invention, the amount of oxygen in the carbonaceous powder is measured according to an infrared absorption method as follows.

An apparatus for simultaneously analyzing oxygen and nitrogen, TC-436 type produced by LECO Ltd. in the United States, is used as an analyzer. At first, a carbonaceous powder sample is weighed, and placed in a graphite crucible. It is heated and cleaned at 600° C., followed by a treatment in an extraction furnace by using He gas as a carrier from which $CO_2$ and $H_2O$ have been removed. The sample is pre-heated to desorb absorption water thereof, and then heated to a fusing point of the sample. Released CO therefrom is further oxidized into $CO_2$ by allowing it to pass through heated copper oxide, and the amount of $CO_2$ is measured by using an infrared detector. Thus the amount of oxygen contained in the carbonaceous powder is calculated. The accuracy of this analyzing method is ±2 ppm or ±2% of a content. The sensitivity of the apparatus is 0.00001% by weight (0.1 ppm).

The average particle diameter of the carbonaceous powder suitable for the dispersed phase of the electrorheological fluid of the present invention is within a range of 0.01–100 microns, preferably within a range of 0.3–10 microns. If it is less than 0.01 micron, the initial viscosity becomes extremely large in a state of no electric field, and the change in viscosity by the electrorheological effect is small, while if it exceeds 100 microns, sufficient stability is not obtained as a dispersed phase of an electrorheological fluid. The particle size of the pitch powder is desirably adjusted beforehand to a particle size of the carbonaceous powder as a final product, that is an average particle diameter of 0.01–100 microns, however, if necessary, particle size adjustment is performed after the infusibility treatment or after the carbonizing treatment to give the average particle diameter of 0.01–100 microns. For the particle size adjustment, it is possible to optionally use a known particle size adjusting means such as grinding by using an ordinary grinder such as jet mill, ball mill, automatic mortar, as well as dry classification, wet classification, and sifting.

The carbonaceous powder thus obtained exhibits an electrorheological effect owing to a polarization function of particles themselves not depending on water. Therefore, it is possible to obtain an electrorheological fluid in which the current consumption is small at a high temperature, and the electrorheological effect can be maintained for a long period of time by using the carbonaceous powder as a dispersed phase. Further, the carbonaceous powder can be produced by means of the heat treatment and the grinding treatment. Thus industrial production becomes easy, and a large yield can be obtained. Further, the carbonaceous powder has a high oxygen content by applying the heat treatment in the oxidizing atmosphere in the infusibility treatment step. Thus the long-term stability such as oxidation resistance is improved.

The electrically insulating oil for constituting the liquid phase can be exemplified by hydrocarbon oil, ester oil, aromatic oil, silicone oil, phosphagen oil and fluorosilicone oil. They can be used singly, or two or more of them can be used in combination. Among these electrically insulating oils, the silicone oil such as polydimethylsiloxane and polymethylphenylsiloxane is excellent in that it can be used even in a state of direct contact with a material having rubber-like elasticity. The phosphagen oil is excellent in that it suppresses sedimentation of the dispersed phase because it has a relatively large specific gravity.

The electrically insulating oil having a viscosity of 0.65–1000 centi-Stokes (cSt), preferably a viscosity of 10–200 cSt at 25° C. is used. If the viscosity of the liquid phase is too low, a volatile portion is increased, and the stability of the liquid phase is deteriorated. If the viscosity of the liquid phase is too high, the initial viscosity with no electric field becomes high, and the change in viscosity owing to the electrorheological effect becomes small. The dispersed phase can be efficiently suspended by using the electrically insulating oil having an appropriately low viscosity as the liquid phase.

With respect to the ratio of the dispersed phase and the liquid phase for constituting the electrorheological fluid of the present invention, the content of the dispersed phase comprising the aforementioned carbonaceous powder is 1–60% by weight, preferably 20–50% by weight, and the content of the liquid phase comprising the aforementioned electrically insulating oil is 40–99% by weight, preferably 50–80% by weight. If the amount of the dispersed phase is less than 1% by weight, the electrorheological effect is small, while if it exceeds 60% by weight, the initial viscosity with no electric field becomes extremely large.

Further, the electrorheological fluid of the present invention can be also blended with other dispersion phases and additives such as surfactant, dispersing agent and inorganic salt, within a range not to damage the effect of the present invention.

BEST MODE FOR CARRYING OUT THE INVENTION

The present invention will be explained below in further detail with reference to Examples.

EXAMPLE 1

A 100% meso-phase pitch having a softening point of 240° C. obtained by heat-polymerizing a condensed polycyclic aromatic compound containing a main component of naphthalene by using $HF/BF_3$ as a catalyst (AR Resin ARA 24 produced by Mitsubishi Gas Chemical Co., Inc.; toluene-insoluble content: 63%, polarization microscope observation: 100% meso-phase) was ground into a powder state, and then treated in air at 200° C. for 7 hours. A powder thus obtained had an oxygen content of 19%. The powder is further subjected to temperature raising in a nitrogen gas atmosphere at a temperature raising speed of 2° C./min up to 370° C., and carbonized by maintaining it for 1 hour followed by natural cooling. A carbonaceous powder thus prepared had an average particle diameter of 4 μm (measured value obtained by using a laser diffraction type particle size distribution meter) and an oxygen content of 15% by weight. 34.5% by weight of the carbonaceous powder was sufficiently dispersed in 65.5% by weight of silicone oil having a viscosity of 10 cSt at 25° C. (TSF 451–10 produced by Toshiba Silicone Co., Ltd.) as a liquid phase component, to obtain an electrorheological fluid as a suspension.

Comparative Example 1

A spinning pitch for general use for carbon fibers obtained from a coal tar pitch in a yield of 35% by weight (melting temperature: 270° C., toluene-insoluble content: 66.2% by weight, polarization microscope observation: isotropic in all planes) was ground into a powder state, and then treated in air at 200° C. for 7 hours. A powder thus obtained had an oxygen content of 5.8% by weight. The powder is further subjected to temperature raising in a nitrogen gas atmosphere at a temperature raising speed of 2° C./min up to 410° C., and carbonized by maintaining it for 1 hour followed by natural cooling. A carbonaceous powder thus prepared had an average particle diameter of 4 microns (measured value obtained by using a laser diffraction type particle size distribution meter) and an oxygen content of 3.4% by weight. 34.5% by weight of the carbonaceous powder was sufficiently dispersed in 65.5% by weight of silicone oil having a viscosity of 10 cSt at 25° C. (TSF 451–10 produced by Toshiba Silicone Co., Ltd.) as a liquid phase component, to obtain an electrorheological fluid as a suspension.

The electrorheological effect was measured for each of the electrorheological fluids obtained in Example 1 and Comparative Example 1. The electrorheological effect was evaluated with a shearing force at a shearing speed of 366 $sec^{-1}$ at a temperature of 25° C. when a direct current voltage of 0–2 kV/mm was applied between inner and outer cylinders by using a double cylinder type rotary viscometer. A current flowing between the inner and outer cylinders was simultaneously measured. Table 1 shows a shearing force $T_0$ with no applied voltage, a shearing force T with an applied voltage of 2 kV/mm, a difference $T-T_0$ therebetween, and a current density with an applied voltage of 2 kV/mm.

TABLE 1

| | $T_0$ (q · cm) | T (g · cm) | $T - T_0$ (g · cm) | Current density ($\mu A/cm^2$) |
|---|---|---|---|---|
| Example 1 | 18 | 282 | 264 | 5.6 |
| Comparative Example 1 | 15 | 226 | 211 | 8.7 |

As shown in Table 1, the current consumption is smaller in the carbonaceous powder having an oxygen content of 15% by weight using a raw material of the 100% meso-phase pitch having a softening point within a range of 150°–400° C. obtained by heat-polymerizing a condensed polycyclic aromatic compound containing a main component of naphthalene by using $HF/BF_3$ as a catalyst than in the carbonaceous powder having an oxygen content of 3.4% by weight using a raw material of the coal tar pitch.

Further, when each of the powders was left in air for one month followed by preparation of electrorheological fluids, and the same measurements were performed, then the current value was not changed from that described above in the case of the sample of Example 1, however, the current value was increased to 17.3 $\mu A/cm^2$ in the case of the powder of Comparative Example 1.

Thus the carbonaceous powder to be dispersed in an electrorheological fluid according to the present invention has high oxidation resistance, and the electrorheological fluid using the same exhibits a high electrorheological effect with a small current consumption amount by application of an electric field of direct or alternating current, and it is excellent in long-term durability.

We claim:

1. A process for producing a carbonaceous powder to be dispersed in an electrorheological fluid, said powder having an oxygen content above 10% by weight but not more than 20% by weight and having an average particle diameter of 0.01–100μm, said process comprising the steps of:

heat-polymerizing a condensed polycyclic compound containing a main component of naphthalene by using $HF/BF_3$ as a catalyst to obtain a 100% meso-phase pitch having a softening point within a range of 150°–400° C.;

heat-treating and making the pitch infusible in an oxidizing atmosphere of a temperature not more than the lesser of a fusing temperature of the pitch or 400° C. and not less than 50° C. to allow the pitch to have an oxygen content of 12–25% by weight; and then heat-treating and carbonizing the pitch in an inert gas atmosphere at a temperature not less than 300° C. and not more than 700° C.

2. A process according to claim 1, wherein said average particle diameter is achieved by means of particle size adjustment.

3. A process according to claim 1, wherein said temperature for heat-treating and making infusible is not less than 200° C. and not more than 300° C.

4. A process according to claim 1, wherein said inert gas atmosphere contains at least one gas selected from the group consisting of nitrogen and argon.

5. A process according to claim 1, wherein the average particle diameter is 0.3 to 10 μm.

6. A process according to claim 1, wherein said temperature for said heat-treating and carbonizing is not less than 350° C. and not more than 550° C.

* * * * *